US006948547B2

(12) United States Patent
Maher

(10) Patent No.: US 6,948,547 B2
(45) Date of Patent: Sep. 27, 2005

(54) OVERHEAD GARAGE DOOR WITH DECORATIVE HOUSE FACADE ELEMENTS

(75) Inventor: Jennifer Armstrong Maher, Chevy Chase, MD (US)

(73) Assignee: FrenchPorte, L.L.C., Chevy Chase, MD (US)

( * ) Notice: Subject to any disclaimer, the term of this patent is extended or adjusted under 35 U.S.C. 154(b) by 45 days.

(21) Appl. No.: 10/098,384

(22) Filed: Mar. 18, 2002

(65) Prior Publication Data

US 2003/0173039 A1 Sep. 18, 2003

(51) Int. Cl.[7] ..... E05D 15/06

(52) U.S. Cl. ..... 160/201; 160/232; 160/236; 49/201

(58) Field of Search ..... 160/201, 232, 160/236; 49/197, 201; 55/455, 457

(56) References Cited

U.S. PATENT DOCUMENTS

| | | | | |
|---|---|---|---|---|
| 275,927 A | | 4/1883 | Reid et al. | |
| 1,784,292 A | | 12/1930 | Johnson | |
| 1,881,778 A | | 10/1932 | Madsen | |
| 1,922,370 A | | 8/1933 | Johnson et al. | |
| 1,989,658 A | | 1/1935 | McCloud | |
| 2,017,012 A | | 10/1935 | Morgan | |
| 2,023,691 A | | 12/1935 | McCloud | |
| 2,093,020 A | | 9/1937 | Norberg | |
| 2,242,499 A | | 5/1941 | Ainsworth | |
| 2,861,836 A | | 11/1958 | Goeggel | |
| 2,951,533 A | | 9/1960 | Lucas et al. | |
| 3,003,200 A | | 10/1961 | Hansen | |
| 3,078,917 A | | 2/1963 | Recchione | |
| 3,118,189 A | | 1/1964 | Dugger | |
| 3,135,544 A | | 6/1964 | Mickey et al. | |
| 3,217,784 A | | 11/1965 | Wolf et al. | |
| 3,703,061 A | * | 11/1972 | Holland et al. | 160/201 |
| 3,922,816 A | * | 12/1975 | Hormann | 49/205 |
| D245,263 S | | 8/1977 | Andresen | |
| D245,264 S | | 8/1977 | Andresen | |
| D245,265 S | | 8/1977 | Andresen | |
| 4,060,437 A | | 11/1977 | Strout | |
| 4,312,328 A | * | 1/1982 | Leyman, III | 126/426 |
| 4,339,487 A | | 7/1982 | Mullet | |
| D273,230 S | | 3/1984 | Martinez et al. | |
| 4,567,494 A | * | 1/1986 | Taylor | 347/30 |
| D283,923 S | | 5/1986 | Henry et al. | |
| D300,466 S | | 3/1989 | Widner | |

(Continued)

FOREIGN PATENT DOCUMENTS

| | | | | |
|---|---|---|---|---|
| GB | 2182969 | * | 5/1987 | 52/455 X |

OTHER PUBLICATIONS

Arm–R–Lite Brochure, 08360/ARM, BuyLine 0796, dated Aug. 1999.

*Primary Examiner*—Bruce A. Lev

(57) ABSTRACT

An overhead garage door having the appearance of a set of light-transmitting doors, such as French doors. The garage door includes arrays of light-transmitting panels on the door arranged to simulate light-transmitting doors, moldings, doorknobs, and hardware for connecting the garage door to a garage. The door may be formed from a plurality of sections arranged in a stack and pivotally connected to adjacent sections. The garage door may be formed from a kit having a plurality of door sections with light-transmitting panels mounted thereon and hinges for connecting the sections. The garage door may also be formed from a retrofit kit for modifying an existing garage door to have the appearance of a set of light-transmitting doors. The light-transmitting panels permit visible light to enter a garage and may be translucent. The panels may be made of polycarbonate acrylic.

13 Claims, 12 Drawing Sheets

U.S. PATENT DOCUMENTS

| | | | | | |
|---|---|---|---|---|---|
| 4,854,365 | A | | 8/1989 | Juneau | |
| 5,016,700 | A | | 5/1991 | Wegner et al. | |
| 5,060,711 | A | | 10/1991 | Fimbell | |
| 5,123,211 | A | | 6/1992 | Schlicht et al. | |
| D330,089 | S | | 10/1992 | Bonger | |
| 5,163,493 | A | | 11/1992 | Kraeutler | |
| 5,163,494 | A | * | 11/1992 | MacNeil et al. | 160/201 |
| 5,168,915 | A | | 12/1992 | LaFleur | |
| 5,341,597 | A | | 8/1994 | Stoltenberg | |
| 5,373,663 | A | * | 12/1994 | Turini | 49/200 |
| 5,577,541 | A | | 11/1996 | McKeon | |
| D378,421 | S | | 3/1997 | Forsland | |
| D378,853 | S | | 4/1997 | Forsland | |
| 5,626,176 | A | | 5/1997 | Lewis, Jr. et al. | |
| D380,053 | S | | 6/1997 | Forsland | |
| D382,065 | S | | 8/1997 | Forsland | |
| D382,066 | S | | 8/1997 | Forsland | |
| D382,067 | S | | 8/1997 | Forsland | |
| D383,551 | S | | 9/1997 | Forsland | |
| D389,921 | S | | 1/1998 | Lee | |
| 5,765,325 | A | * | 6/1998 | DeBlock | 52/204.5 |
| D397,447 | S | | 8/1998 | Forsland | |
| 5,848,630 | A | | 12/1998 | Munzo | |
| 5,852,903 | A | * | 12/1998 | Astrizky | 52/202 |
| 5,860,711 | A | * | 1/1999 | Kronberg et al. | 312/1 |
| 6,079,168 | A | * | 6/2000 | Shaver | 52/202 |
| 6,227,278 | B1 | * | 5/2001 | Forsland | 160/107 |
| 6,314,689 | B1 | * | 11/2001 | Hughes | 52/203 |
| D452,979 | S | | 1/2002 | Maher | |
| 6,446,695 | B1 | * | 9/2002 | Forsland | 160/201 |
| 2001/0037613 | A1 | * | 11/2001 | Owens | 52/71 |
| 2003/0005636 | A1 | | 1/2003 | Forsland | |
| 2003/0037888 | A1 | * | 2/2003 | Mochizuki et al. | 160/201 |
| 2003/0051827 | A1 | * | 3/2003 | Snyder | 160/201 |
| 2003/0221803 | A1 | | 12/2003 | Forsland | |

* cited by examiner

OVERHEAD GARAGE DOOR WITH DECORATIVE HOUSE FACADE ELEMENTS

FIELD OF THE INVENTION

This invention relates generally to a garage door that presents a decorative façade incorporating elements complementary with the style of a house. More particularly, the present invention relates to an overhead garage door whose appearance simulates an attractive arrangement of light-transmitting doors.

BACKGROUND OF THE INVENTION

Garage doors are generally known in the art as structures that form a movable barrier in an entryway to a garage. Most garage doors are formed from a vertical stack of horizontally folding sections interconnected by hinges and supported by a guide track, or from an integral flat slab door that swings upward. Typical garage doors, as well as garages in general, are often less attractive than the rest of the building to which they are attached or associated. They tend not to blend in well with the style of the home or other building.

For residential properties having a stylized façade, a typical garage door presents a plain, monolithic blank space that detracts from the overall appearance of the home. This is especially true for front load garage doors, where the garage door dominates a large portion of the front view of the house. To improve their attractiveness, conventional garage doors often include raised panel structures on the outside of the doors or ornamental windows through the doors. Nevertheless, conventional garage doors are monolithic in appearance and immediately recognizable as such. They generally present a boring, predictable appearance that does not vary much between houses and which tends to detract heavily from the aesthetic value of the home.

For those conventional garage doors that have ornamental windows, the windows are typically a single row of small windows along the top of the door that permit a trivial amount of light to enter into the garage. Such windows are inappropriate when the garage is being used for more than a storage area. Residential garages are increasingly being used for purposes other than simply storing vehicles. They are often being used as activity rooms where the ingress of natural light is desirable, such as hobby shops, game rooms, playrooms and family rooms. The ingress of natural light is desirable in these activity areas for many different reasons. For example, natural light is known to promote a more healthful environment by reducing the amount of mold and mildew in a room, and by transmitting antibacterial properties, thereby reducing allergic reactions and infections. Moreover, the use of natural light versus artificial light saves utility costs and is generally more pleasing.

SUMMARY OF THE INVENTION

The present invention provides for a garage door that incorporates decorative elements of the façade of the house. Thus, the garage as a whole, as well as the entryway into the garage, blends in with the style of the house as an attractive feature. In combination with façade elements, the present invention addresses the need for more natural light inside the garage.

One example of such an overhead garage door is one that appears to be a set of French doors. A set of French doors typically includes two or more doors that each has an array of light-transmitting panels, or lights, that transmit visible light in at least one direction. The term "light" is used to refer to a transparent, semi-transparent or translucent panel in a solid door or window. Transparent panels are clear and transmit almost all visible light through the panel, whereas semi-transparent panels transmit only a portion of the light that is transmitted through the transparent panel. Translucent panels are somewhat transparent and diffuse light as it passes through the panel.

The decorative façade elements of an overhead garage door according to the present invention include two or more arrays of light-transmitting panels arranged to give the appearance of a set of light-transmitting doors, such as French doors. The façade elements may further include a door handle located proximate to each one of the arrays, moldings, and borders, such as grooves in the garage door, simulating the jambs of the light-transmitting doors.

The light-transmitting panels on the garage door permit light into the garage, thus allowing the benefits of natural light without having to open the overhead garage door. Such natural light is particularly beneficial when the garage is being used as a modified living space, such as for a workspace, play space, or pet space. The ingress of natural light in these activity areas is generally more pleasing than the use of artificial light, and is desirable for promoting a more healthful environment and for saving utility costs. Natural light may also be beneficial for using the garage as a garden space or greenhouse, or for other reasons.

The panels in one embodiment are translucent, thus providing the benefits of natural light without allowing persons outside of the garage to look into the garage. They may also be reflective on the outside for denying persons a view into the garage. The panels may be made from polycarbonate acrylic sheets, which are lightweight and yet provide high impact resistance. In addition, the use of polycarbonate acrylic material allows the light transmissibility, color, privacy, tint and other characteristics to be customized.

In addition to properties of the light-transmitting panels, the size, shape, and arrangement of the panels can be customized to blend in with a wide variety of house styles. In one embodiment, the panels can be arranged into a grid pattern of a three by five array of divided lights to simulate a set of French doors and to generally match divided light windows, which are common on many houses. In another embodiment, the panels can be arranged into a smaller door pattern having a two by five array. Also, the panels can have decorative curvilinear borders to blend with a variety of house styles, or can be a variety of shapes, such as rectangular, octagonal, or circular.

The structure of the overhead garage door in one embodiment is a conventional sectioned garage door that rolls between a closed position and an open position along a pair of lateral guide rails. The structure can easily include unitary overhead garage doors that swing upwards or other types of garage doors. The overhead garage door in one embodiment includes a kit for making a garage door that simulates a set of light-transmitting doors. The kit generally includes a door with light-transmitting panels mounted thereon and hardware for assembling and mounting the garage door to a garage. The overhead garage door in a further embodiment includes a retrofit kit that modifies an existing garage door to simulate a set of light-transmitting doors. The retrofit kit generally includes light-transmitting panels and doorknobs for mounting to an existing garage door.

DETAILED DESCRIPTION OF THE INVENTION

Figure 1:
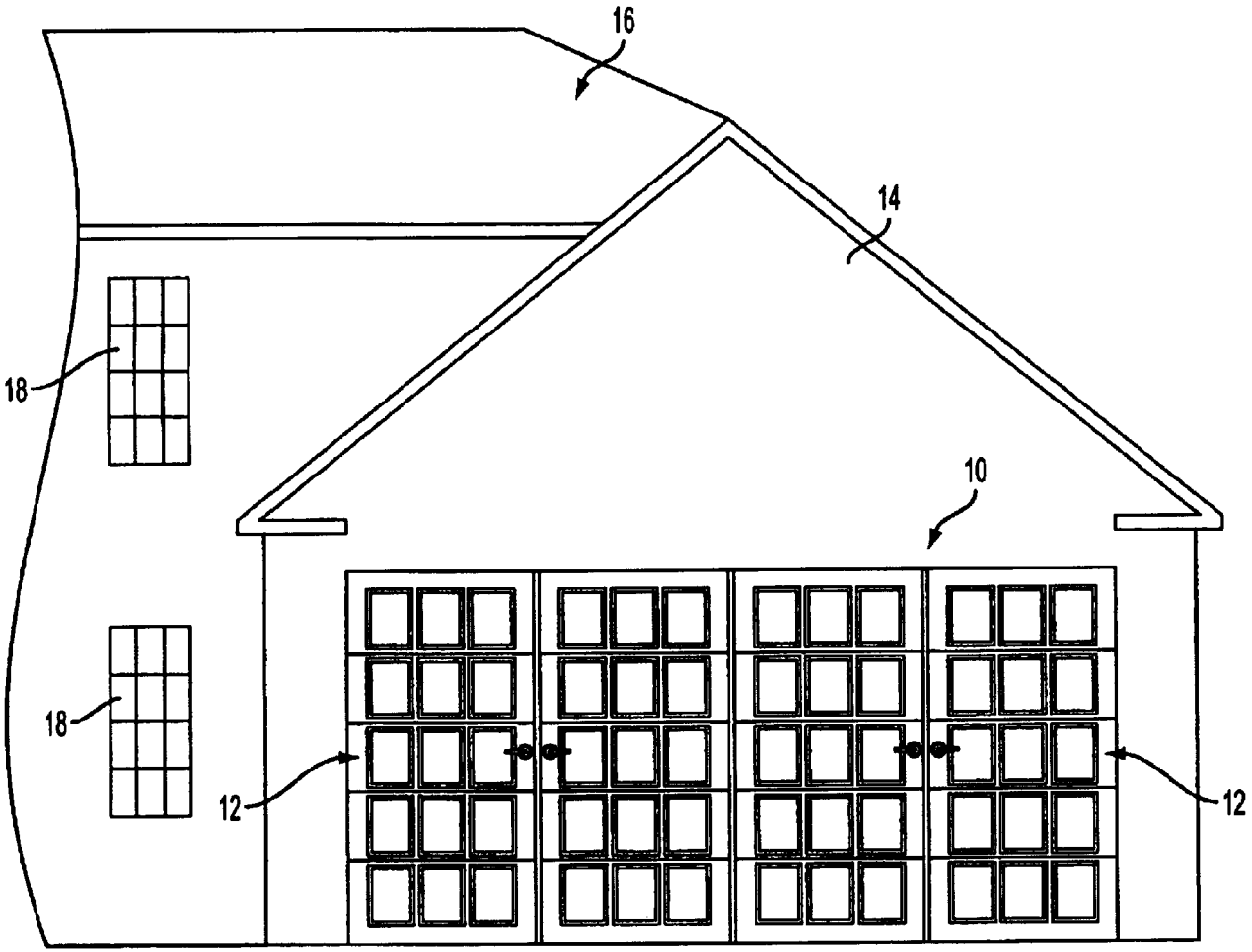
FIG. 1 shows a portion of a house with an attached garage having an embodiment of an overhead garage door in accordance with the present invention.

One embodiment of the present invention is the overhead garage door 10 depicted in FIG. 1 that includes decorative façade elements 12 that simulate a set of four light-transmitting doors known commonly as French doors. A set of French doors typically includes two doors each having an array of divided lights. In the garage door 10, the lights are light-transmitting panels that transmit visible light.

Figure 2:
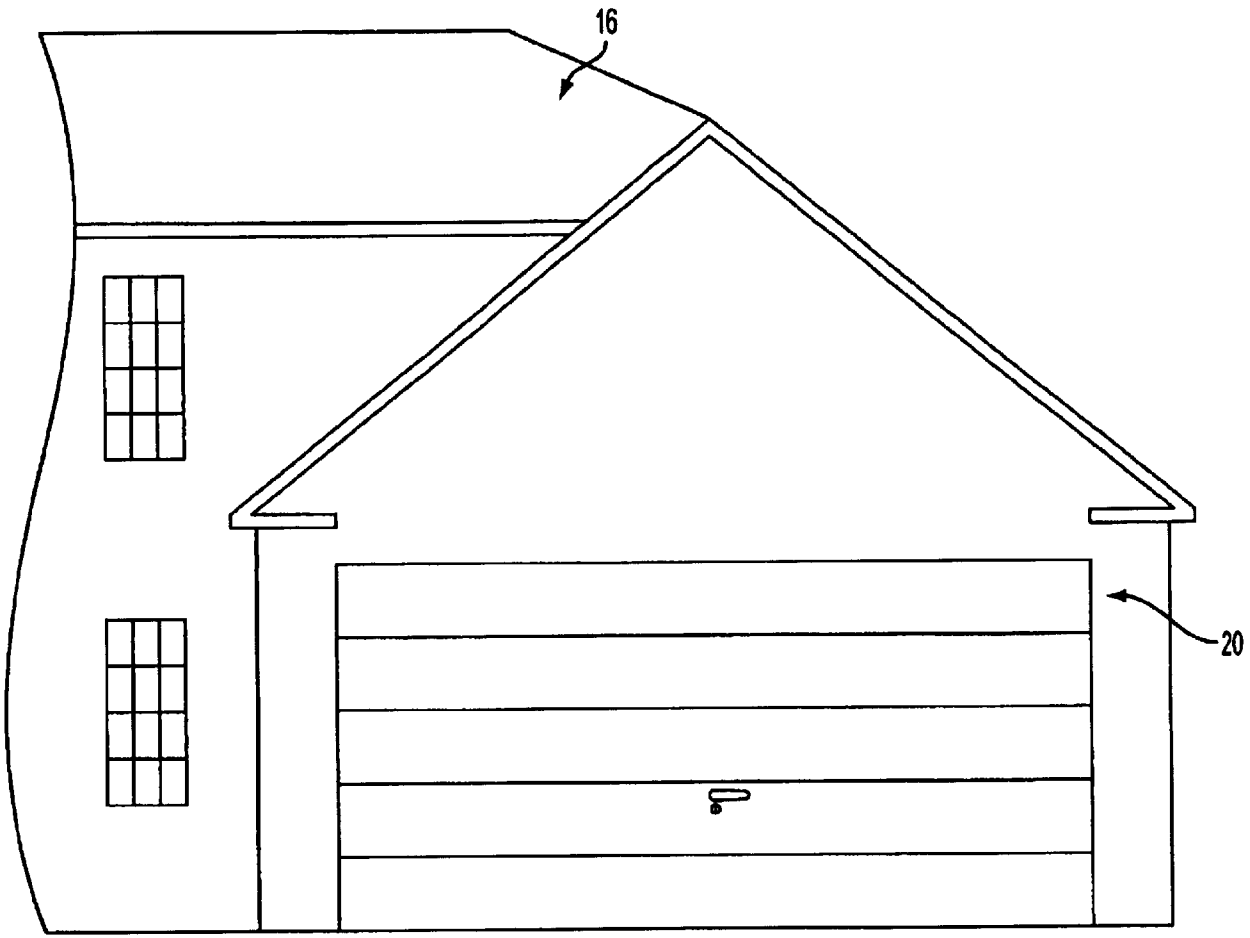
FIG. 2 PRIOR ART
FIG. 2 shows the house of FIG. 1, but with a conventional overhead garage door.

The garage door 10 is shown installed on a garage 14 of a conventional house 16. For illustration purposes, the house includes divided light windows 18. The façade elements 12 give the garage door 10 an attractive appearance that blends well with the style of the house 16, particularly with the divided light windows 18 of the house. In contrast, FIG. 2 shows a conventional garage door installed on the same conventional house 16. Rather than blending in with the style of the house 16, the conventional garage door 20 stands out as a monolithic blank space that detracts from the appearance of the house.

Figure 3:
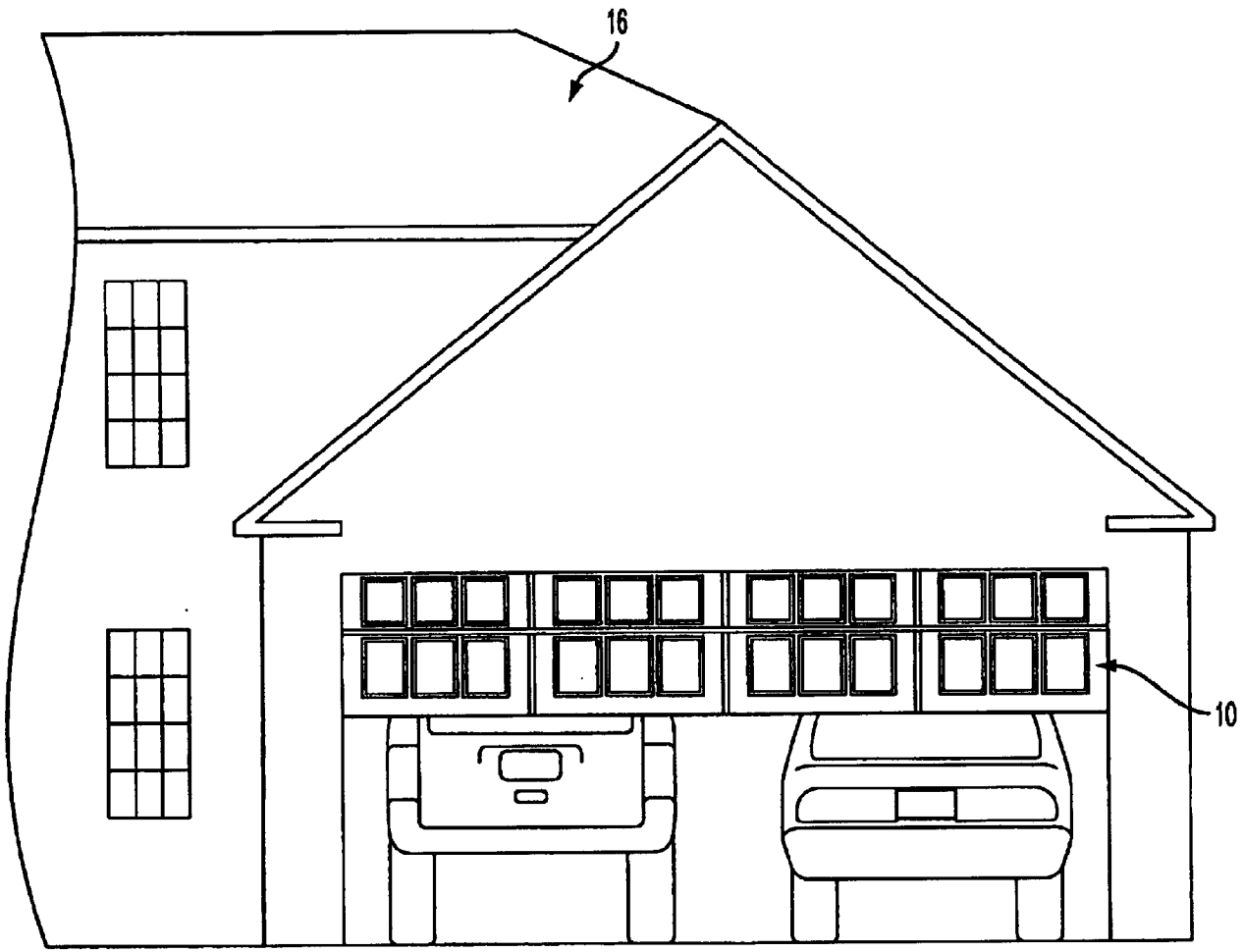
FIG. 3 shows the garage door of FIG. 1, but with the overhead garage door shown in a partially opened condition.

Referring now to FIGS. 4–7, the overhead garage door 10 includes a door 22, four arrays 24 of light-transmitting panels 26, guide rollers 28, and guide tracks 30. The door 22 includes sections 32 arranged in a stack, and hinges 34 pivotally connecting adjacent sections 32. Guide rollers 28 are connected to edge portions of the sections 32 and are retained in a guide track 30 attached to the garage. The track has a vertical section and a horizontal section and extends at a right angle from a vertical position to a horizontal position. The guide rollers 28 are each received in a channel 31 in one of the guide tracks 30. The garage door 12 opens and closes by rolling on the guide rollers along the guide tracks 30 from a vertical closed position to an overhead horizontal open position, and vice versa, as is known in the art. To illustrate, FIG. 3 shows garage door 10 in a position intermediate between the opened and closed position. Although embodied herein as a sectioned garage door, the present invention works as well with unitary, slab-type overhead garage doors as are known in the art, or with other types of overhead garage doors.

Figure 4:
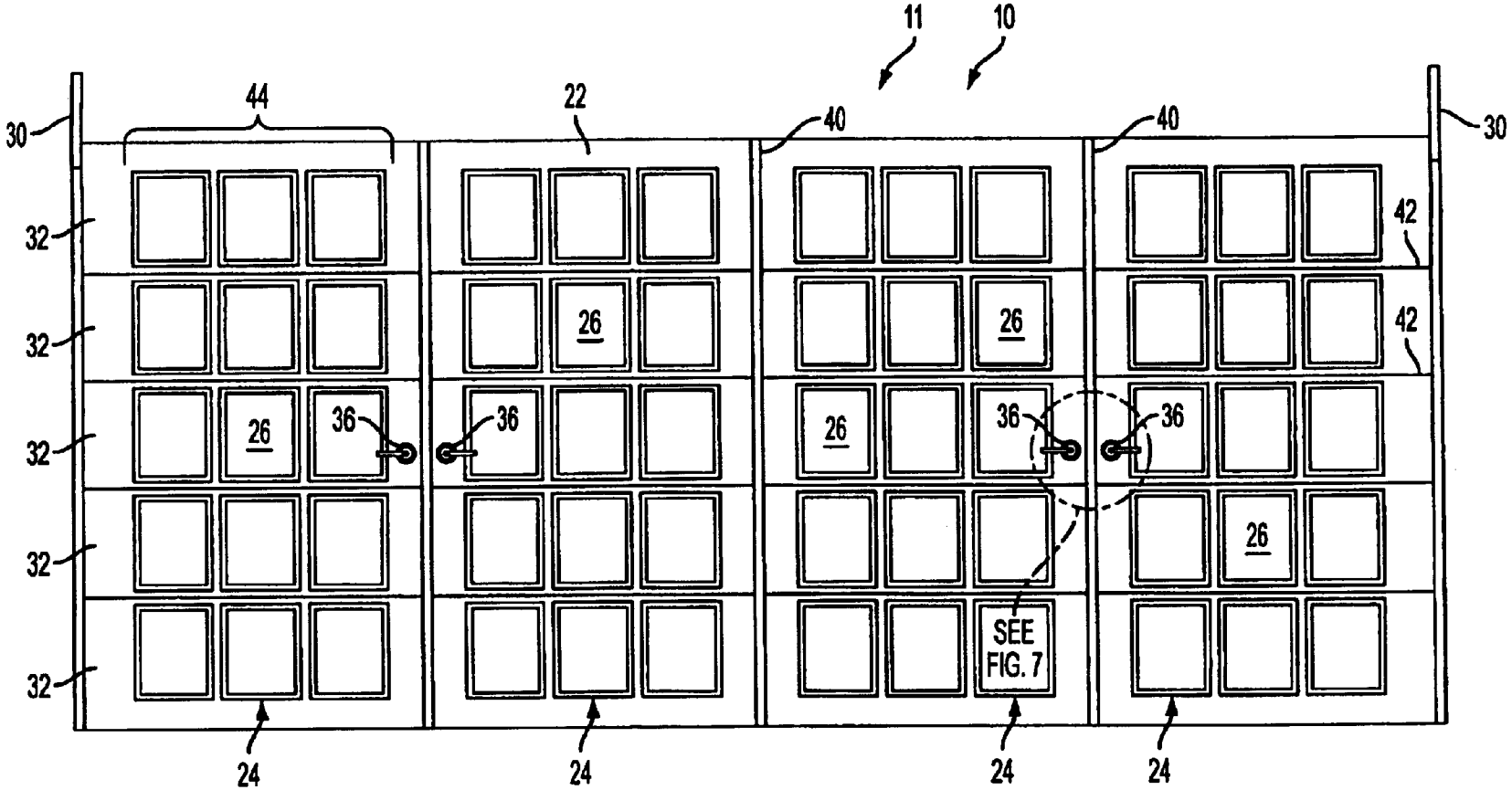
FIG. 4 is an exterior elevational view of the garage door of FIG. 1, including guide rails for connecting the door to the garage.
Figure 5:
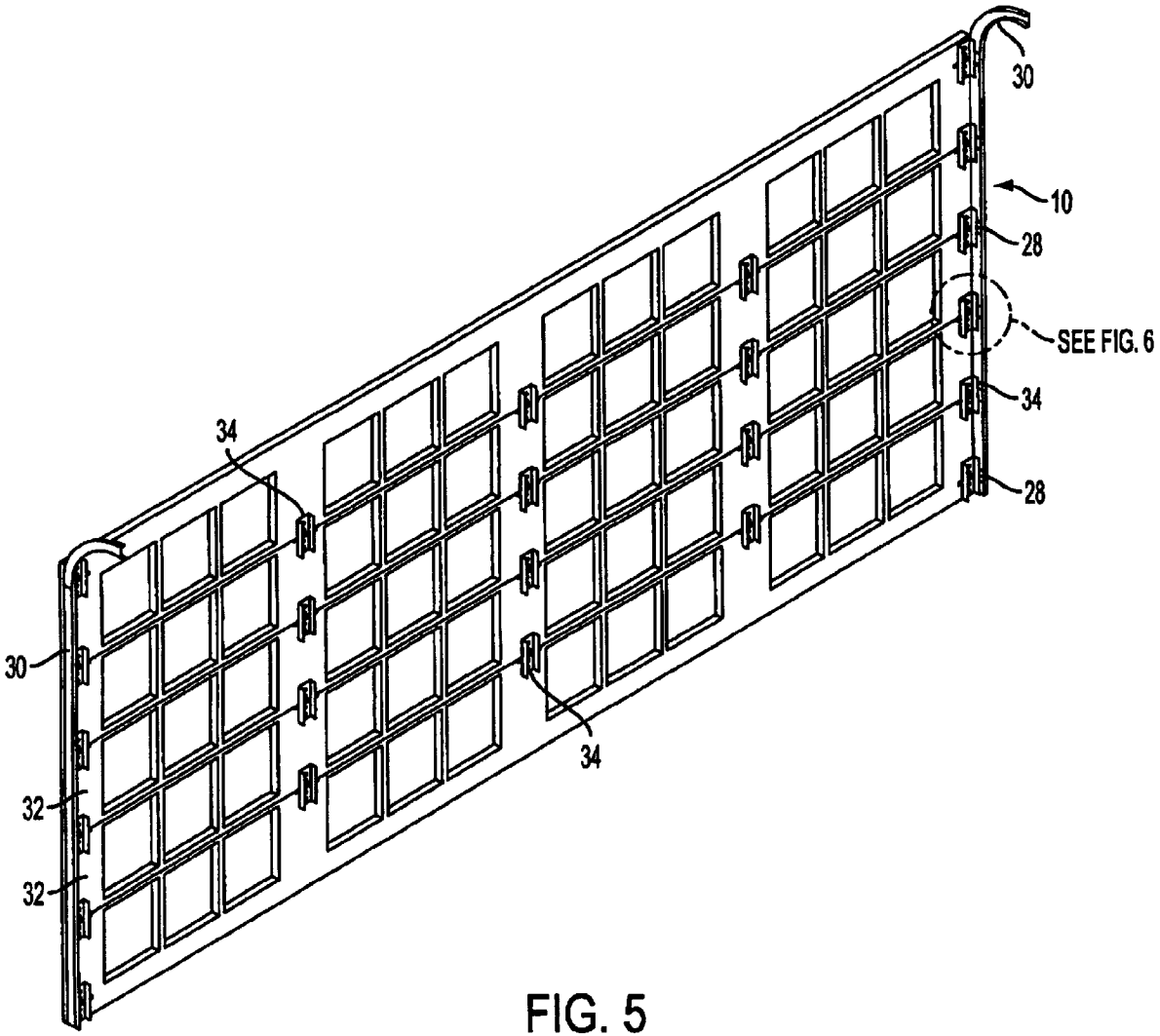
FIG. 5 shows an interior perspective view of the garage door of FIG. 4.
Figure 6:
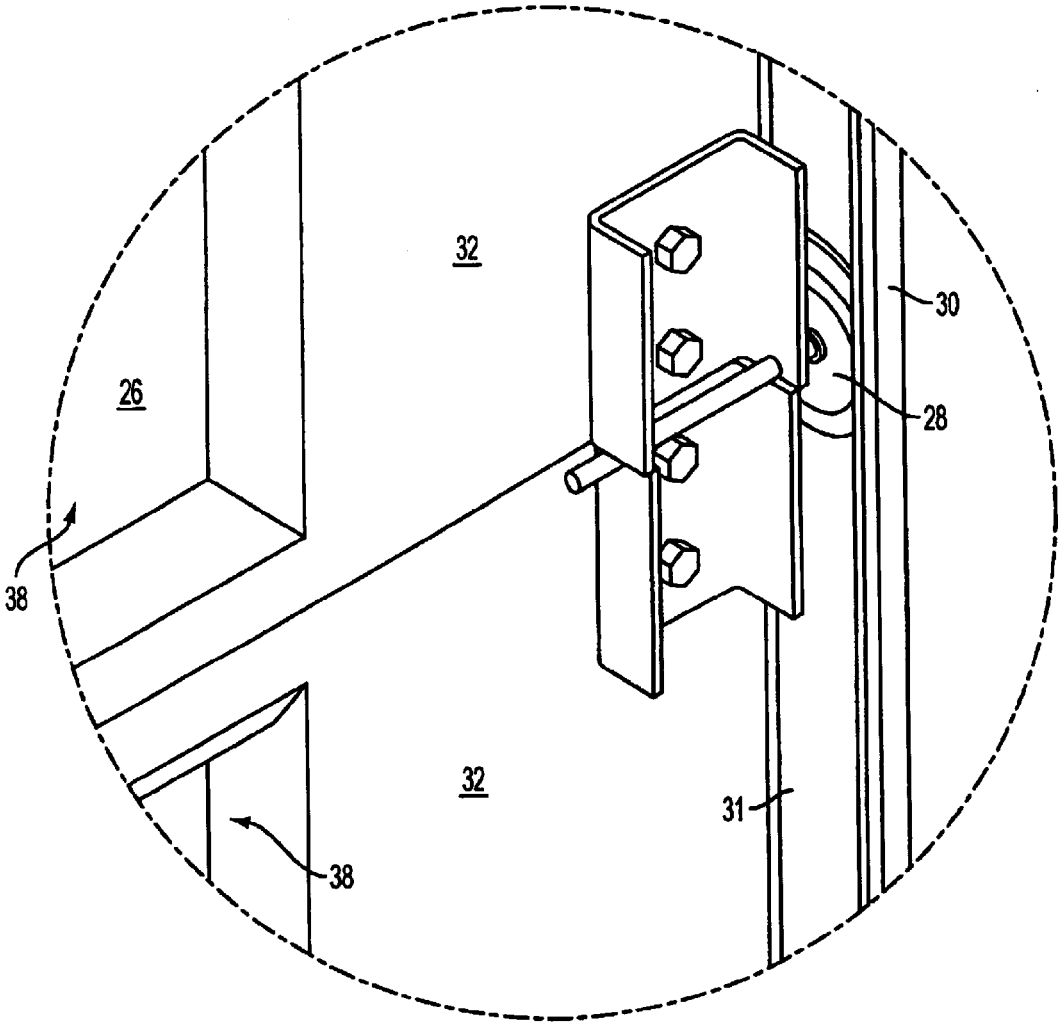
FIG. 6 shows a close-up perspective view of an interior portion of the garage door of FIG. 5, including a roller connected to a guide rail.
Figure 7:
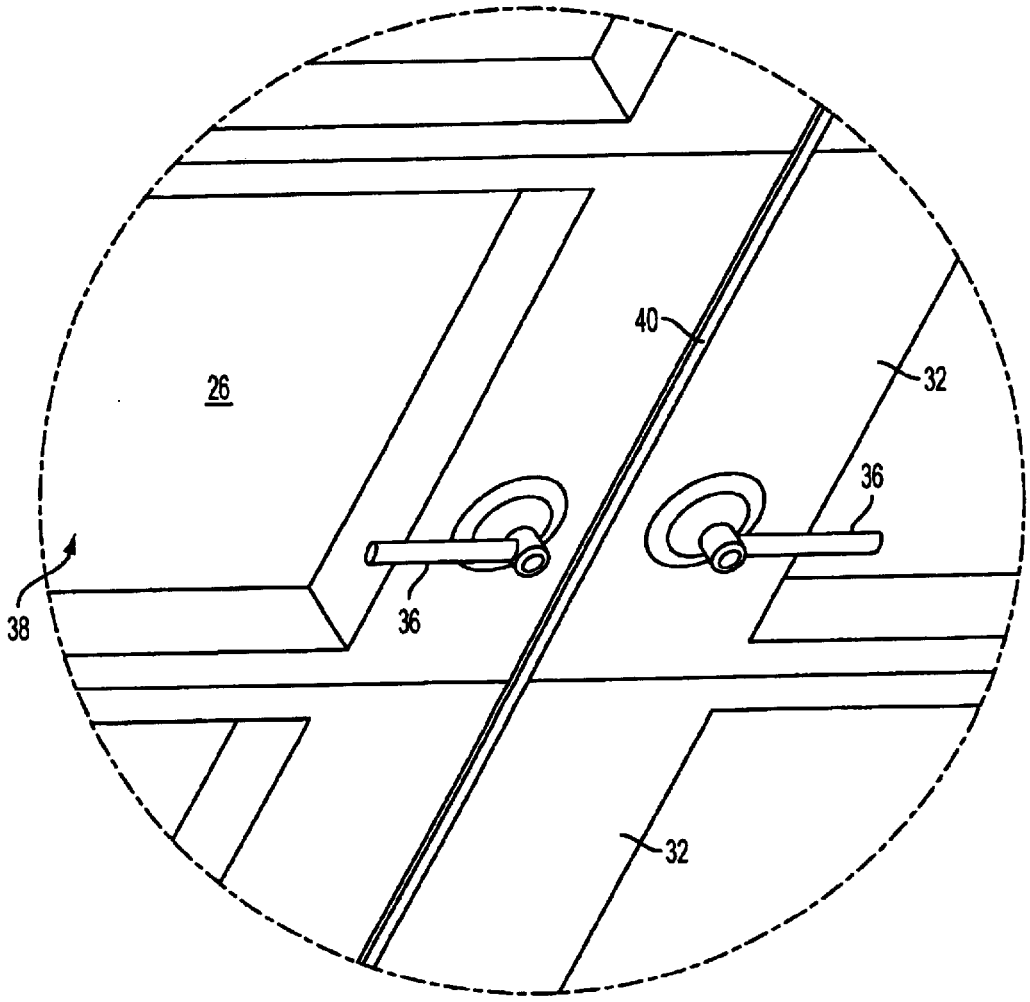
FIG. 7 shows a close-up perspective view of an exterior portion of the garage door of FIG. 4, including a vertical groove and door handles.

The arrays 24 of light-transmitting panels 26 shown in FIGS. 1 and 3–5 each include five rows by three columns, which generally match the appearance of regular French doors. The arrays 24 are spaced from one another along the door 22 to give the appearance of four separate passage doors. To enhance the appearance of separate doors, the overhead garage door 10 further includes door handles 36. Each array 24 in combination with a corresponding handle 36 generally forms a façade element 12 to simulate a light-transmitting door. Although the door handles 36 do not function to open the simulated doors 24, they may act as functional latches for opening the garage door 10 or as handles for lifting the garage door 10. To further simulate the appearance of French doors, each one of the light-transmitting panels 26 appear to be glazed in a section 32 as shown in FIGS. 6 and 7, which is similar to the manner in which glass is often glazed in window frames. Accordingly, beveled moldings 38 are provided in the sections 32 for retaining the light-transmitting panels 26. The panels 26 retained therein are able to transmit light from the outside environment into the interior of the garage 14.

The light-transmitting panels 26 preferably are translucent panels, which provide the benefit of transmitting light between the outside environment and the interior of the garage 14 without allowing persons outside of the garage 14 to clearly see into the garage. Thus, the present invention allows in a greater amount of natural light into the garage 14 compared with a conventional garage door. According to other embodiments, the light-transmitting panels 26 may include transparent panels, reflective panels, tinted panels, one-way mirrored panels, and the like to provide a desired level of privacy without sacrificing light. Further, the door arrays 24 may include a mix of different panel types, and may include opaque panels. Thus, the quantity of light transmitted into and out of the garage 14 can be custom tailored according to the light transmissibility of each one of the panels 26.

The panels 26 are preferably made of material which can be customized in appearance and strong enough to be a barrier in an environment that is prone to weather exposure, shop conditions, or other adverse environments. One example of such a material is polycarbonate acrylic sheets, which are lightweight and provide high impact resistance. These sheets can be made to have various light transmission properties, which can range from transparent to opaque. Polycarbonate acrylic sheets can also be made in a variety of colors and tints. The present invention further contemplates panels 26 made from a wide variety of plastics, glass, or other light-transmitting materials.

To enhance the effect of the façade elements 12 in simulating French doors, the door 22 also includes three vertical grooves 40. Each groove 40 is placed between a pair of panel arrays 24 to simulate the jambs of a set of adjacent doors. The grooves 40 additionally emphasize the appearance of simulated doors by drawing the eye away from the horizontal lines 42 created by the junction of adjacent sections 32. The grooves 40 are accentuated in comparison with the horizontal lines 42 by being much wider and deeper than the horizontal lines. Painting the grooves a dark color further increases their visual effect.

The garage door 10 of the present invention can be created from a kit 11 for making an overhead garage door that simulates a set of light-transmitting doors. Referring specifically to FIGS. 4 and 5, the kit 11 generally includes a number of sections 32 and a number of hinges 34 for connecting the sections 32. A row of light-transmitting panels 26 are mounted on each section 32, and the panels of each row are arranged in groups 44 of three panels spaced apart from adjacent groups. The garage door 10 is created by arranging the sections 32 into a stack to form the door 22, and connecting adjacent sections 32 to each other with hinges 34. The kit 11 also includes guide rollers 28 and guide tracks 30 for mounting the assembled door to a garage, and door handles 36 for mounting on one of sections 32.

Figure 14:
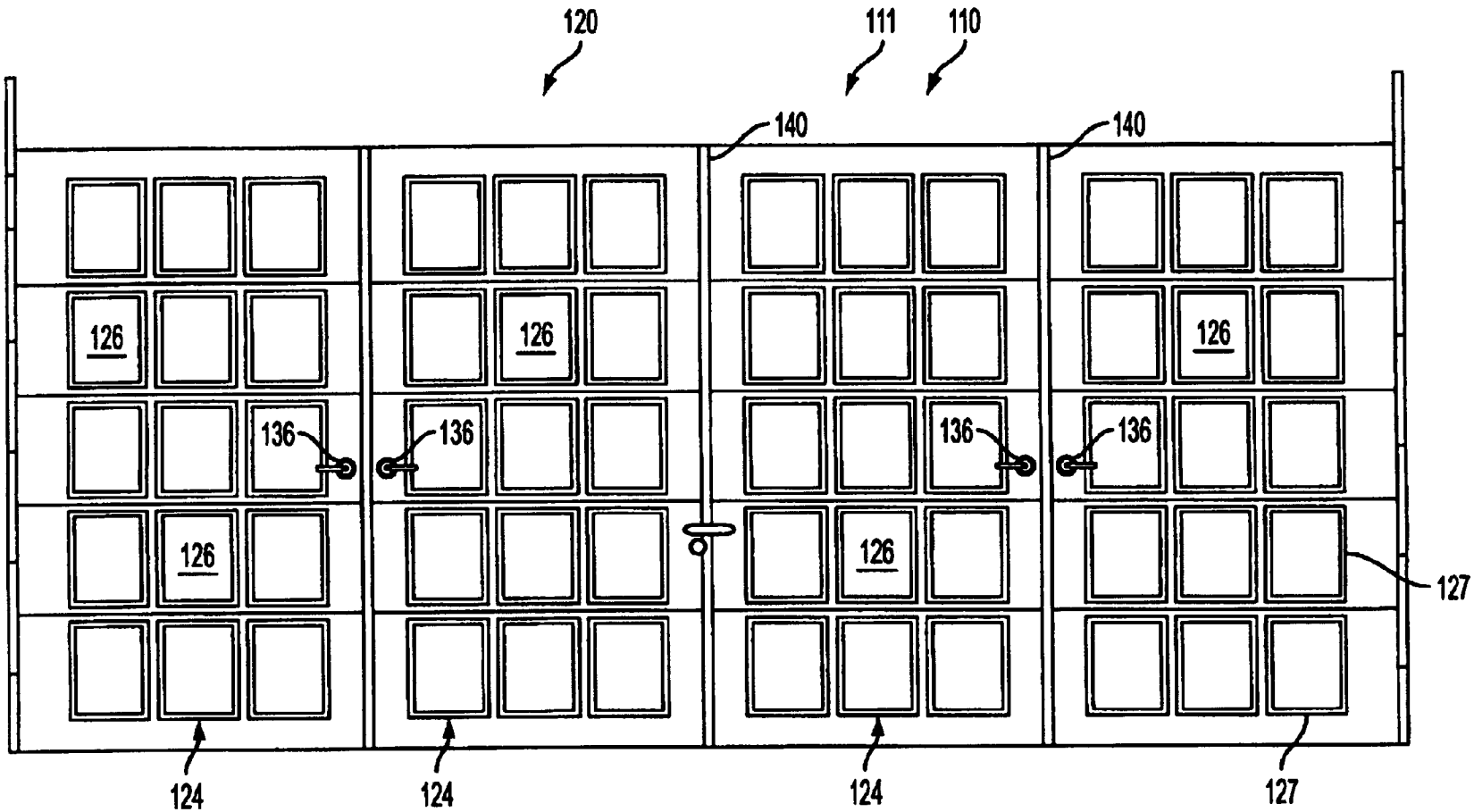
FIG. 14 shows an exterior elevational view of an additional embodiment of an overhead garage door in accordance with the present invention.

A garage door 110 according to another embodiment of the present invention can be created from a retrofit kit 111 for modifying the appearance of an existing overhead garage door to simulate a set of light-transmitting doors. Referring to FIG. 14, the retrofit kit 111 generally includes decorative panels 126 and door handles 136. The decorative panels 126 are mounted to a conventional garage door 120 (such as the conventional garage door 20 shown in FIG. 2) in a set of arrays 124 to give it the appearance of a set of French doors. In order to allow light to transmit through the panels 126, holes (not shown) may be cut into the garage door 120 prior to mounting the panels. The panels may be mounted over or within the holes (not shown) according to known methods. The panels may include beveled edges 127 to simulate the frame elements of a French door. The handles 136 are each mounted next to an array 124 to further simulate light-transmitting doors. An optional vertical stripe 140 may be painted onto the garage door 120 to simulate the jambs of adjacent simulated French doors.

Figure 8:
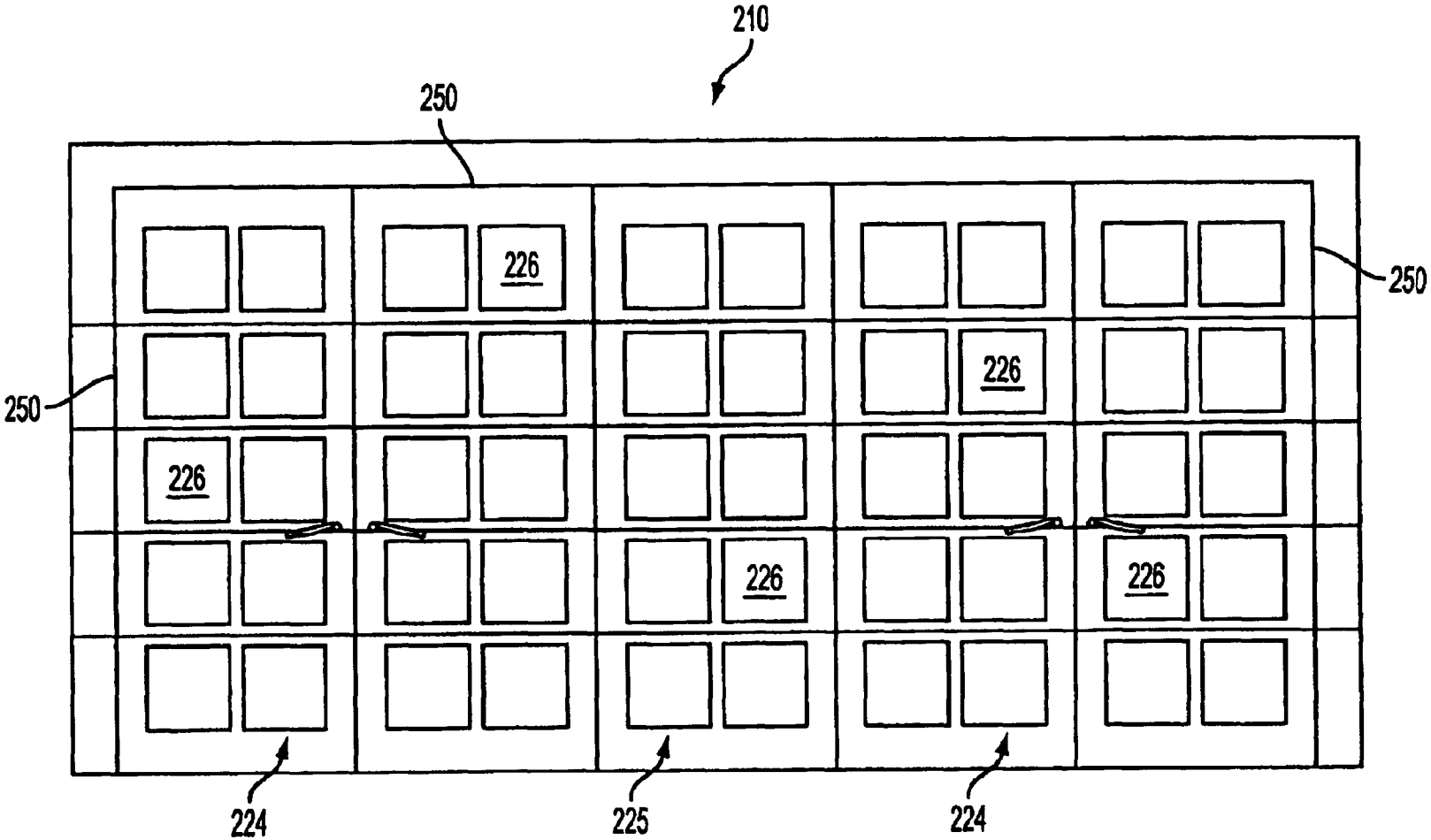
FIG. 8 shows an exterior elevational view of another embodiment of an overhead garage door in accordance with the present invention.

The present invention is flexible in that it allows for variety in the design of façades and in the types of light-transmitting doors simulated. For example, a further embodiment of an overhead garage door in accordance with the present invention is shown in FIG. 8. In this embodiment, there are five arrays 224 of light-transmitting panels 226 simulating a set of four light-transmitting doors centered about a window array 225. The arrays 224 are arranged into two by five arrays having two columns and five rows. The garage door 210 further includes borders 250 simulating the jambs and top edges of each simulated door and the window. The borders 250 are preferably formed by grooves in the garage door, but may also be formed from painted stripes, adhesive strips, and other methods for marking a border. Except for preferences and aspects related to number, arrangement and size of arrays 224, or to the simulated borders 250, all other preferences and aspects are generally the same as for the previous embodiments.

Figure 9:
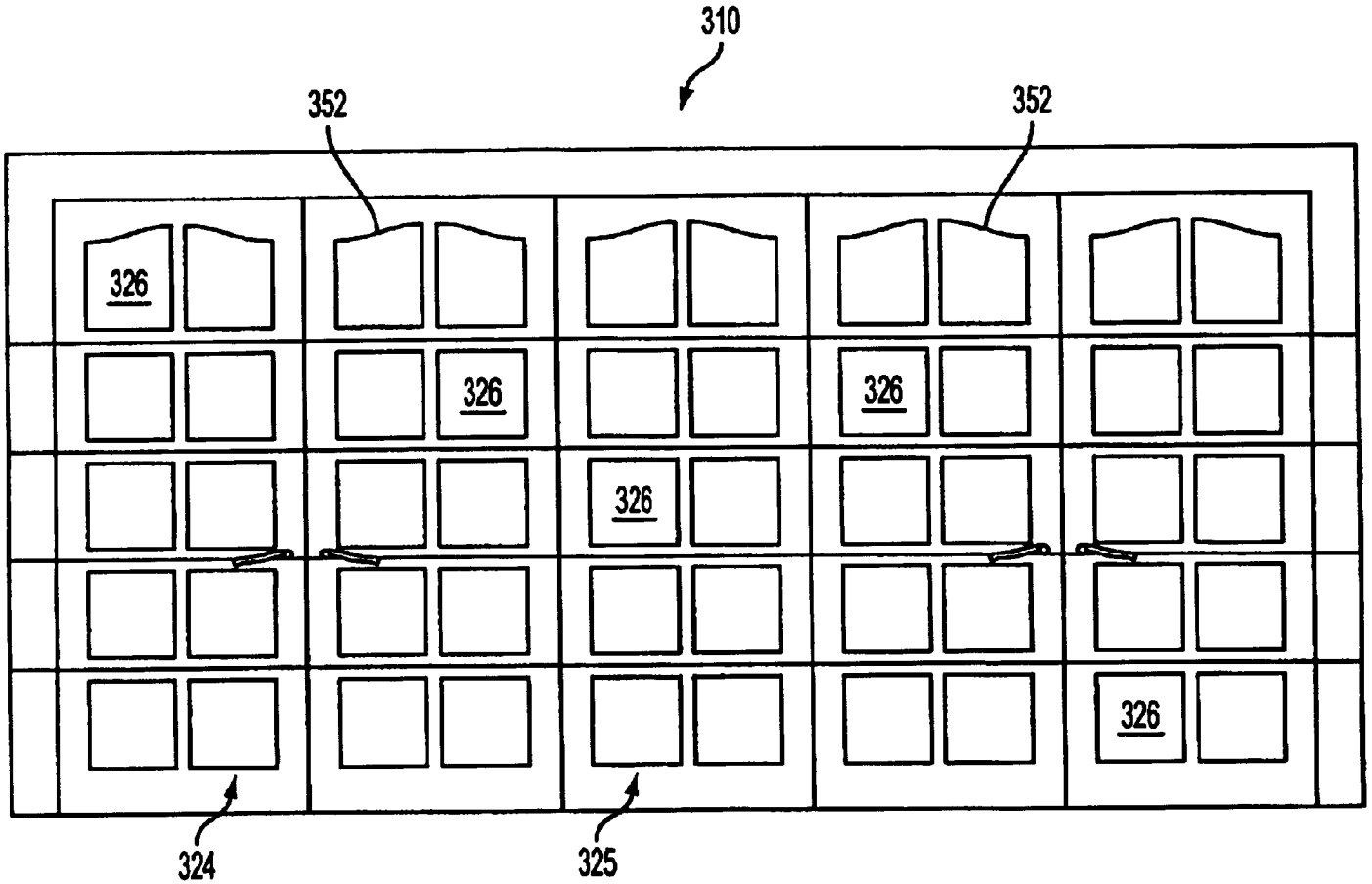
FIG. 9 shows an exterior elevational view of a further embodiment of an overhead garage door in accordance with the present invention.
Figure 10:
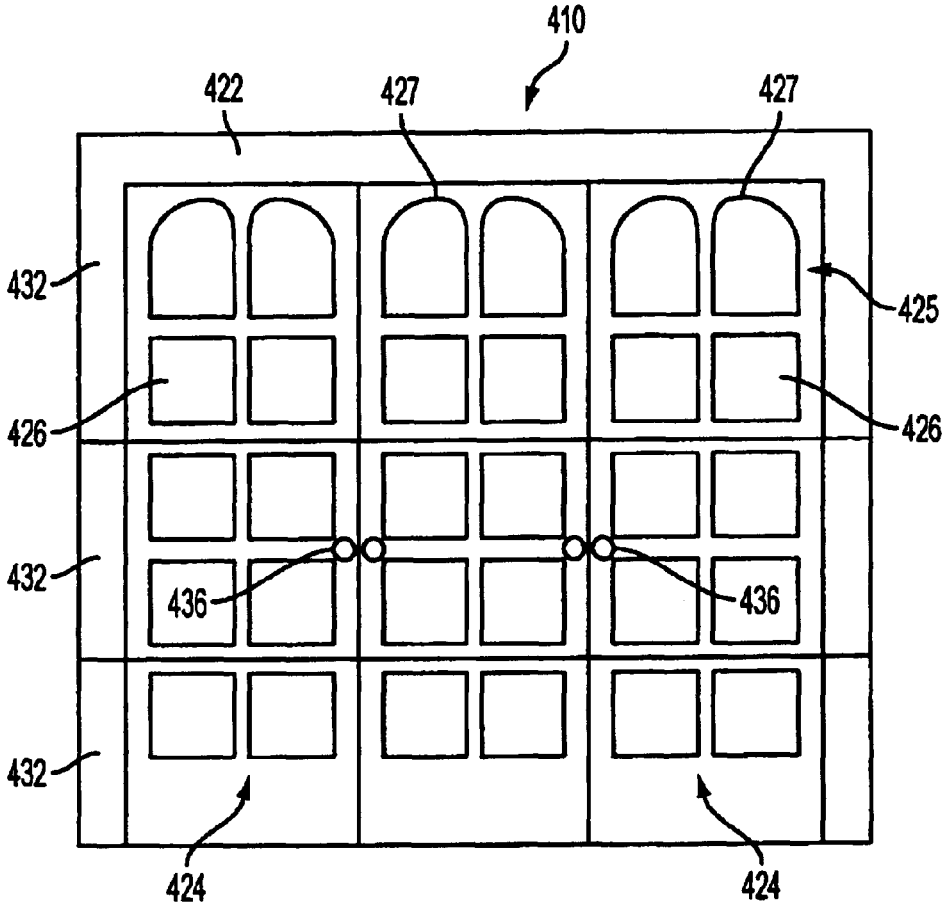
FIG. 10 shows an exterior elevational view of yet another embodiment of an overhead garage door in accordance with the present invention.
Figure 11:
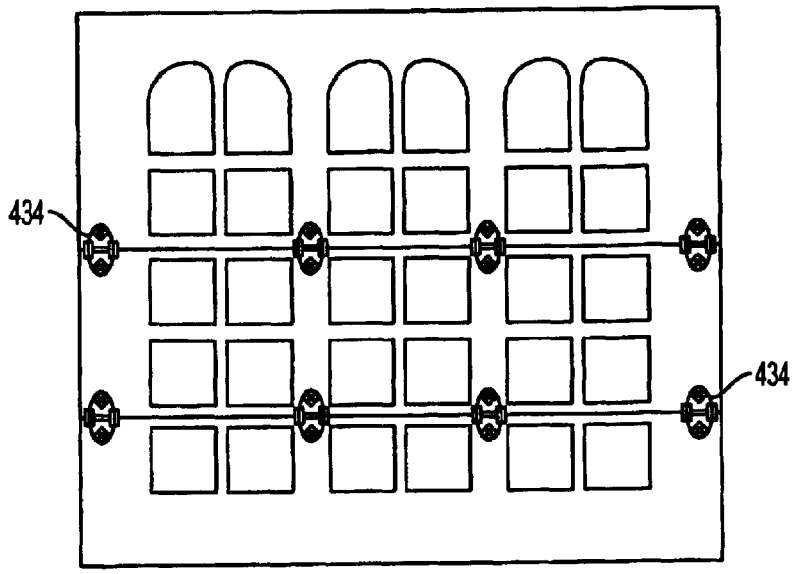
FIG. 11 shows an interior elevational view of the garage door of FIG. 10.
Figure 12:
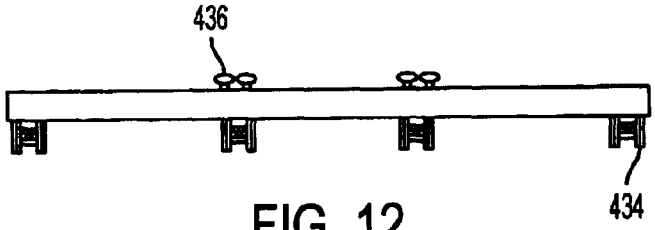
FIG. 12 shows a top view of the garage door of FIG. 10.
Figure 13:
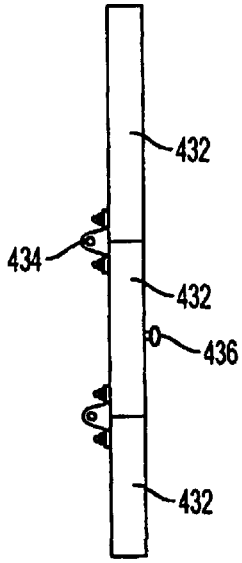
FIG. 13 shows a side view of the garage door of FIG. 10.

The present invention also provides flexibility in the size and type of panels used for the simulated light-transmitting doors. For example, an additional embodiment of an overhead garage door 310 in accordance with the present invention is shown in FIG. 9. This embodiment differs from the embodiment shown in FIG. 8 in that each panel in the top row of panels 326 include an ornate arching curvature 352 along its top edge. As illustrated in the top row 352, the panels 326 need not be rectangular or uniform in size and shape, and may include any number of decorative variations.

Referring now to FIGS. 10–13, yet another embodiment of an overhead garage door 410 in accordance with the present invention is shown. This embodiment demonstrates further flexibility in design according to the present invention, particularly for garage door design as well as for panel design and array layout. The garage door 410 according to this embodiment generally includes a door 422 and three arrays 424 of light-transmitting panels 426 simulating a set of three light-transmitting doors. The door 422 includes three sections 432 arranged in a vertical stack, and hinges 434 pivotally connecting adjacent ones of sections 432. The sections 432 in this embodiment are of different sizes, with the top section being wider than the middle section and bottom sections, and the middle section being wider than the bottom section. The arrays 424 are arranged into two by five arrays having two columns and five rows.

The garage door 410 represented by this embodiment demonstrates a number of design differences from other embodiments. For example, the panels 426 located in the top row 425 of each array are taller than the panels located in lower rows. In addition, each panel in the top row 425 has an arcuate top edge 427. Although the panels 426 are arranged into five rows, the panels are spaced over only three sections 432. Accordingly, the top two rows in each array are located on the top section, the middle two rows in each array are located on the middle section, and the lower row of each array is located on the lower section. As such, the simulated windows in each of the simulated doors appear to be upwardly offset from the bottom of the corresponding simulated door. The garage door 210 further includes borders 250 simulating the edges and tops of each simulated door, and round doorknobs 436 to enhance the appearance of doors.

While the present invention has been illustrated and described by use of the appearance of French doors as shown in FIGS. 1, 3–5, 8–11 and 14, the invention could embody other decorative elements that match style elements of the house façade. For example, the translucent panels could be configured to simulate the look of custom windows or other façade elements of the building. The use of a decorative façade for a garage door in combination with light-transmitting panels to provide natural light into the garage is not limited to the specific illustrated embodiments.

I claim:

1. An overhead garage door adapted to be suspended horizontally when open and incorporating decorative elements of a house façade, the door having a front side, a rear side and a height, the front side forming an exterior façade having the appearance of a plurality of adjacent doorways, the garage door comprising:

three longitudinal sections arranged in a stack;

a first array of impact resistant, light-transmitting first panels formed in the three longitudinal sections, the first array extending vertically more than half the height of the door, the first array including a first vertical stack of light-transmitting panels and a second vertical stack of light-transmitting panels, the first vertical stack being horizontally spaced apart from the second vertical stack by a first gap;

a second array of impact resistant, light-transmitting second panels formed in the three longitudinal sections, the second array extending vertically more than half the height of the door, the second array including a third vertical stack of light-transmitting panels and a fourth vertical stack of light-transmitting panels, the third vertical stack being horizontally spaced apart from the fourth vertical stack by a second gap;

a third array of impact resistant, light-transmitting first panels formed in the three longitudinal sections, the third array vertically extending more than half the height of the door, the third array including a fifth vertical stack of light-transmitting panels and a sixth vertical stack of light-transmitting panels, the fifth vertical stack being horizontally spaced apart from the sixth vertical stack by a third gap;

a first vertical column formed by portions of the three longitudinal sections disposed within a first horizontal space between the first array and the second array, the first vertical column being wider than the first and second gaps;

a second vertical column formed by portions of the three longitudinal sections disposed within a second horizontal space between the second array and the third array, the second vertical column being wider than the second and third gaps; and a plurality of guide rollers;

wherein said light-transmitting panels permit light from the front side to transmit through the door to the rear side, said arrays being arranged on said exterior façade to simulate adjacent, light-transmitting doorways, and said impact resistant light-transmitting panels in conjunction with said vertical columns provide the functionality of structural integrity for the garage door.

2. The overhead garage door of claim 1, wherein each one of the sections are pivotally connected to adjacent sections.

3. The overhead garage door of claim 1, wherein each one of the light-transmitting panels is embedded in the door.

4. The overhead garage door of claim 1, wherein the light-transmitting panels comprise translucent panels.

5. The overhead garage door of claim 1, wherein the light-transmitting panels comprise transparent panels.

6. The overhead garage door of claim 1, wherein the light-transmitting panels comprise a one-way reflective surface reflecting light incident to one side of the surface and transmitting light incident to an opposing side of the surface.

7. The overhead garage door of claim 1, wherein the door further comprises moldings around each one of the light-transmitting panels retaining the panels in the arrays.

8. The overhead garage door of claim 1, wherein the first and the second arrays are arranged to look like French doors.

9. The overhead garage door of claim 1, further comprising a fourth array of light-transmitting fourth panels on the door having a plurality of rows and a plurality of columns.

10. The overhead garage door of claim 9, further comprising:

a plurality of vertical grooves in the door, each one of the vertical grooves adjacent to one of the arrays of light-transmitting panels and simulating a jamb of a light-transmitting door.

11. The overhead garage door of claim 1, further comprising:

a first door handle mounted to the door proximate to the first array; and a second door handle mounted to the door proximate to the second array.

12. The overhead garage door of claim 1, wherein the door has a first edge and an opposing second edge and each one of the guide rollers are attached to one of the edges, the overhead garage door further comprising:

a first guide track receiving the guide rollers attached to the first edge; and a second guide track receiving the guide rollers attached to the second edge.

13. The overhead garage door of claim 1, wherein the door comprises a unitary slab adapted to pivot between its closed substantially vertical position and its open substantially horizontal position.

* * * * *